United States Patent [19]

Conn et al.

[11] 4,030,663

[45] June 21, 1977

[54] TUBE ADAPTOR FOR CENTRIFUGE ROTOR BUCKET

[75] Inventors: Thomas E. Conn, Palo Alto; Victor J. Grilli, Mountain View, both of Calif.

[73] Assignee: Beckman Instruments, Inc., Fullerton, Calif.

[22] Filed: Apr. 4, 1974

[21] Appl. No.: 457,710

[52] U.S. Cl. ..... 233/26; 206/427; 211/74; 220/17; 220/21

[51] Int. Cl.[2] ..... B04B 5/02

[58] Field of Search ..... 233/26, 27, 25, 1 R, 233/26; 211/74; 229/28 BC; 220/17, 21, DIG. 15; 206/203, 427; 217/19

[56] References Cited

UNITED STATES PATENTS

| | | | |
|---|---|---|---|
| 1,010,016 | 11/1911 | Campau | 233/26 |
| 1,307,482 | 6/1919 | Cheek | 211/74 X |
| 1,334,109 | 3/1920 | Mojonnier | 233/26 |
| 1,698,489 | 1/1929 | Bickford | 211/74 |
| 2,110,308 | 3/1938 | Nelson | 233/26 X |
| 2,416,999 | 3/1947 | Keith et al. | 217/19 X |
| 2,510,591 | 6/1950 | Listman | 211/74 X |
| 2,565,299 | 8/1951 | Erickson | 211/74 |
| 2,821,339 | 1/1958 | Wyble | 233/26 |
| 3,335,894 | 8/1967 | Laird | 220/21 |
| 3,674,198 | 7/1972 | Eberle | 233/26 |
| D131,007 | 1/1942 | Carlson | 211/74 X |

FOREIGN PATENTS OR APPLICATIONS

| | | | |
|---|---|---|---|
| 576,395 | 5/1959 | Canada | 233/26 |
| 607,862 | 9/1960 | Italy | 211/74 |

*Primary Examiner*—George H. Krizmanich
*Attorney, Agent, or Firm*—R. J. Steinmeyer; F. L. Mehlhoff; W. H. May

[57] ABSTRACT

An adaptor for use in a centrifuge bucket for evenly distributing a number of cylindrical test tubes thereacross and for maximizing the number of test tubes positionable in the bucket. The adaptor comprises a thin, flat, disc-shaped plate having a diameter approximately equal to the inside diameter of the bucket and a plurality of separate, unconnected partitions made integral with and extending normal to one side of the plate, the partitions defining a plurality of cavities for receipt of the bases of the test tubes. The partitions support substantially less than the entire circumference of each tube and have lengths which are substantially less than the lengths of the tubes. A lifting tray and handle provide means for lifting the adaptor and test tubes from the rotor bucket.

3 Claims, 6 Drawing Figures

FIG. 1.
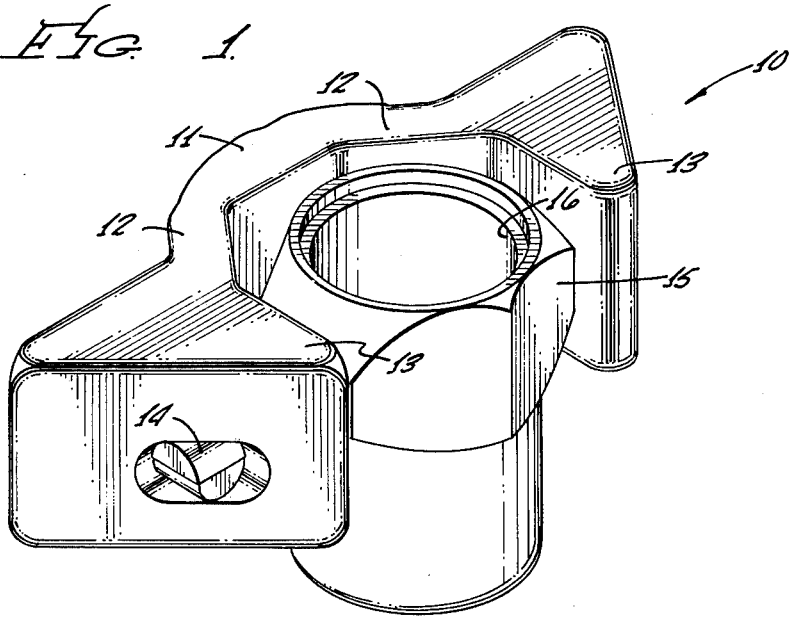
FIG. 2.
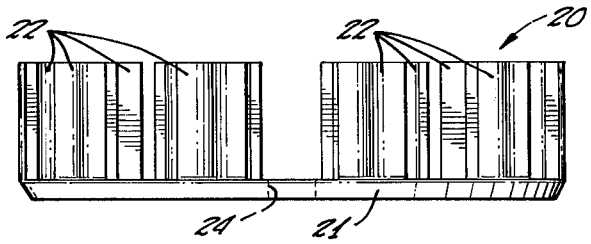
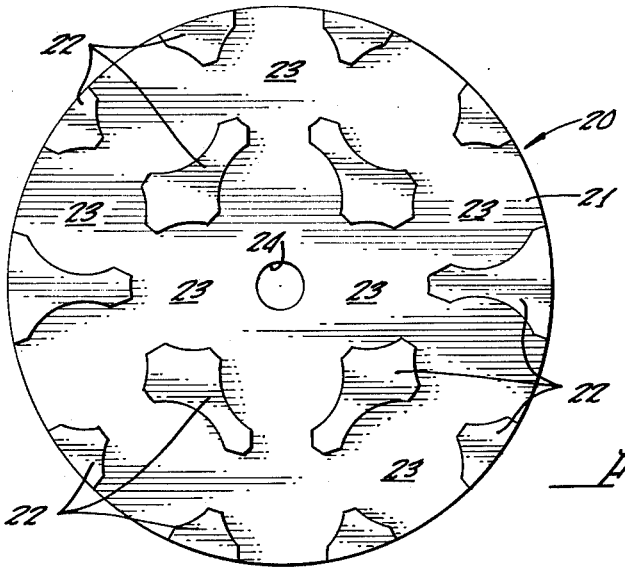
FIG. 3.

TUBE ADAPTOR FOR CENTRIFUGE ROTOR BUCKET

BACKGROUND OF THE INVENTION

1. Field of the Invention

The present invention relates to tube adaptors for centrifuge rotor buckets and, more particularly, to adaptors for use in centrifuge rotor buckets for maximizing the number of cylindrical test tubes positionable in the bucket.

2. Description of the Prior Art

A common type of centrifuge rotor includes carriers or buckets supported on trunnion pins disposed at the ends of outwardly extending arms. One centrifuge rotor of this type is described in U.S. Pat. No. 3,722,791 issued Mar. 27, 1973 to Herschel E. Wright for Centrifuge Rotor With Removable Trunnion Pins and assigned to Beckman Instruments, Inc., Fullerton, Calif., the assignee of the present application. These buckets are adapted to receive samples to be separated into their constituent components under the influence of centrifugal forces. With power applied to the drive shaft of the centrifuge thereby rotating the rotor arms, each bucket swings outwardly until the axis thereof is perpendicular to the rotational axis of the rotor.

It is common to first position the samples either in one high capacity bottle or in a multitude of smaller bottles or test tubes held in position by an adaptor. While no particular problem results from the use of one high capacity bottle, several problems have occured with adaptors used heretofore.

In the past, available tube adaptors for centrifuge rotor buckets have permitted the use of a number of test tubes in a given cavity which is far less than the optimum capacity of the cavity. Previously, it was the practice to support each test tube around the entire circumference thereof and for substantially the entire length thereof. Thus existing adaptors have been substantial structures, of significant weight. Furthermore, existing tube adaptors have been expensive to fabricate. Still an additional problem has been a convenient and simple means for loading, stacking, and removing the adaptor and the test tubes from the centrifuge rotor buckets.

SUMMARY OF THE INVENTION

In accordance with the present invention, these problems are solved by the provision of a novel tube adaptor for use in a centrifuge rotor bucket. The present tube adaptor evenly distributes a number of test tubes across the cross-section of the bucket and maximizes the number of test tubes which are positionable in the bucket. This is achieved by providing an adaptor in which each test tube is supported for substantially less than the entire circumference thereof and for a distance which is substantially less than the length thereof. Since the tubes are not supported for their full lengths, the present tube adaptor has a minimum weight and may be fabricated at a minimum cost. On the other hand, the present tube adaptor is fully operative to support each test tube individually and it is not necessary for all tubes to be in place to support the remaining tubes. The present tube adaptor is easily molded or cast and requires no special machining.

The present invention also includes a novel lifting tray and lifting handle useable with the present tube adaptor to permit convenient loading of a first group of test tubes into the rotor bucket, stacking of a second group of test tubes in the rotor bucket, and subsequent removal of all test tubes therefrom.

Briefly, the present adaptor for use in a centrifuge bucket for maximizing the number of cylindrical test tubes positionable in the bucket comprises a thin, flat, disc-shaped plate having a diameter approximately equal to the inside diameter of the bucket and a plurality of separate, unconnected partitions made integral with and extending normal to one side of the plate, the partitions defining a plurality of cavities for receipt of the bases of the test tubes. The partitions support substantially less than the entire circumference of each tube and have lengths which are substantially less than the lengths of the tubes.

According to the preferred embodiment of the invention, the partitions position the test tubes in two substantially concentric circular patterns, the tubes in the first or outer circular pattern being virtually in contact with each other and the walls of the bucket and the tubes in the second or inner circular pattern being virtually in contact with each other and the tubes in the first circular pattern.

The present invention also includes a thin, flat, disc-shaped tray having a diameter less than the inner diameter of the bucket and an elongate, generally rod-shaped lifting handle, one end of the lifting handle being connectable to the center of the tray. The handle extends through a central hole in the plate of the adaptor thereby positioning the tray in contact with the other side of the plate and permitting positioning of the tray and the plate into the bucket. A second adaptor is stackable over the test tubes positioned in the cavities in the first plate.

OBJECTS

It is therefore an object of the present invention to provide a tube adaptor for centrifuge rotor buckets.

It is a further object of the present invention to provide apparatus for supporting test tubes in centrifuge rotor buckets.

It is a still further object of the present invention to provide an adaptor for use in a centrifuge bucket for maximizing the number of cylindrical test tubes positionable in the bucket.

It is another object of the present invention to provide a tube adaptor for centrifuge rotor buckets which has a minimum weight since the test tubes are not supported for their full lengths.

It is still another object of the present invention to provide a tube adaptor for centrifuge rotor buckets which may be fabricated in a simple manner, at a minimum cost.

Another object of the present invention is the provision of apparatus for supporting test tubes in a centrifuge bucket comprising a plurality of adaptors for supporting plural test tubes and a novel means for stacking the adaptors in the bucket.

Still other objects, features, and attendant advantages of the present invention will become apparent to those skilled in the art from reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is a partial perspective view of a centrifuge rotor showing a swingable carrier or bucket;

FIG. 2 is a side elevation view of an adaptor constructed in accordance with the teachings of the present invention;

FIG. 3 is a top plan view of the adaptor of FIG. 2;

DESCRIPTION OF THE PREFERRED EMBODIMENT

Figure 4:
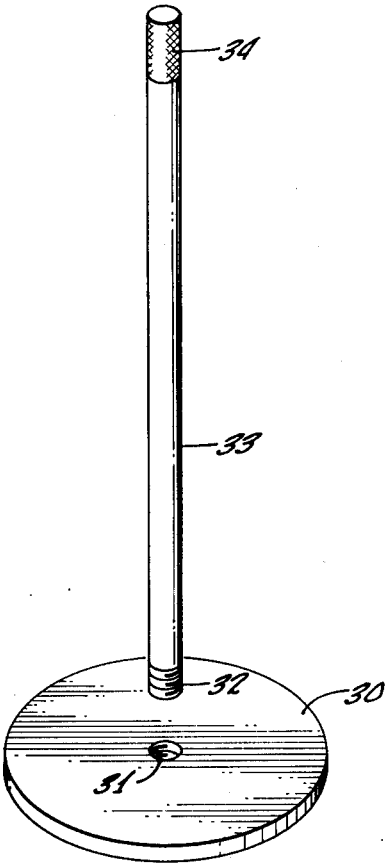
FIG. 4 is an exploded perspective view of a lifting tray and handle for use with the adaptor of FIGS. 2 and 3.

Referring now to the drawings and, more particularly, to FIG. 1 thereof, there is shown a portion of a centrifuge rotor, generally designated 10, of the type described in the beforementioned U.S. Pat. No. 3,722,791. More specifically, rotor 10 includes a core 11 which is provided with a central hole (not shown) for mounting the rotor on an associated rotatable drive shaft (not shown). Rotor 10 is provided with arms 12 which extend radially outward from the axis of rotor 10, arms 12 terminating in support portions 13. Portions 13 of arms 12 support first ends of trunnion pins 14, the other ends of which are connected to opposite sides of a swinging bucket or carrier 15. Thus, bucket 15 is suspended on the ends of pins 14, between adjacent arms 12.

Bucket 15 is an elongate, generally cylindrical member defining a cylindrical cavity 16 for receipt of a sample to be subjected to the centrifugal forces generated upon rotation of core 11 by the rotor drive shaft (not shown). Upon the rotation of core 11, bucket 15 swings outwardly such that the axis thereof is perpendicular to the centrifuge drive shaft.

Referring now to FIGS. 2, 3, 5, and 6, there is shown an adaptor, generally designated 20, for use in cavity 16 of bucket 15. More specifically, adaptor 20 includes a thin, flat disc-shaped plate 21 having a diameter approximately equal to the inside diameter of bucket 15. A slight difference in the diameters of bucket 15 and plate 21 is sufficient to permit plate 21 to readily slip into cavity 16. Adaptor 20 also includes a plurality of separate, unconnected partitions, generally designated 22, partitions 22 preferably being made integral with and extending normal to one side of plate 21. Partitions 22 define a plurality of cavities 23 for receipt of the bases of a plurality of cylindrical test tubes 17 having flat bottoms, as known in the art.

In order to absolutely maximize the number of test tubes 17 in a given cavity 16 while minimizing the weight and fabrication expense of adaptor 20, partitions 22 incorporate several unique features. In the first instance, partitions 22 support substantially less than the entire circumference of each test tube 17. Furthermore, partitions 22 have lengths which are substantially less than the lengths of test tubes 17. Considering the fact that the force of each test tube 17 on adaptor 20 is essentially axial and born by plate 21, partitions 22 need only provide sufficient lateral support to support test tubes 17 before being inserted into bucket 15 and during the procedure of insertion and removal. Therefore, partitions 22 do little more than provide a point of support on the sides of each test tube 17, for substantially less than half of the lengths thereof and, as a practical matter, for less than 20 percent of the length thereof. In terms of actual configuration, partitions 22 fill a portion of the gaps left between test tubes 17 when they are evenly distributed across the circular cross-section of bucket 15.

Figure 6:
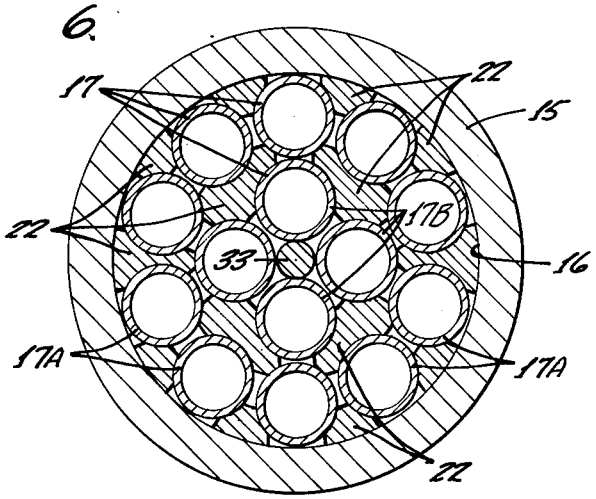
FIG. 6 is a sectional view taken along the line 6—6 of FIG. 5.

Considering typical sizes of available buckets 15 and available test tubes 17, optimizing the number of test tubes 17 in a given cavity is achieved, according to the preferred embodiment of the present invention, by positioning test tubes 23 in two circular patterns. As shown in FIG. 6, the test tubes 17A in a first or outer circular pattern are essentially in contact with each other or closely spaced from each other and are positioned in contact with or closely spaced from the walls of bucket 15. The test tubes 17B in a second or inner circular pattern are spaced inwardly of test tubes 17A and are either in contact with each other and tubes 17A or are closely spaced therefrom. However, it will be apparent to those skilled in the art that different sizes of buckets and/or test tubes may require different shapes and numbers of patterns and that the present invention is neither limited to circular patterns nor two patterns.

Plate 21 with integral partitions 22 is preferably molded or cast from a suitable plastic material requiring no additional machining. Having a flat base, adaptor 20 may be readily placed on a suitable support, externally of bucket 15, for loading of test tubes 17 therein. A test tube 17 may be put in any one or more of cavities 23 and it is not necessary for a test tube 17 to be positioned in all of cavities 23 since each cavity 23 fully supports the test tube 17 positioned therein. No test tube is completely surrounded by material, it is only surrounded where necessary for support. Finally, each test tube 17 would normally incorporate a full cap 18 (see FIG. 5).

Figure 5:
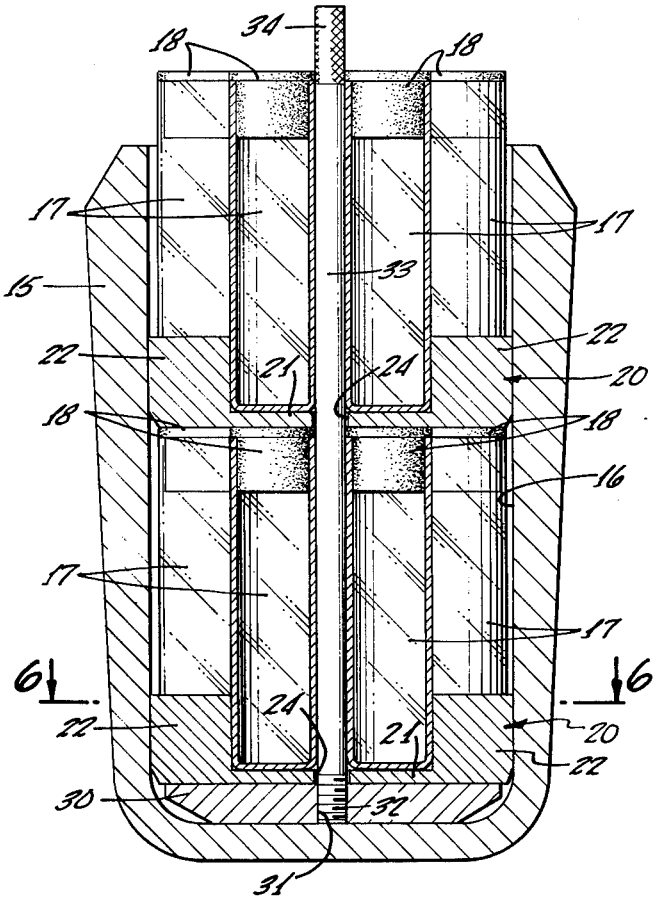
FIG. 5 is a longitudinal sectional view of the bucket of FIG. 1 with the adaptor of FIGS. 2 and 3 and the lifting tray and handle of FIG. 4 positioned therein together with a plurality of cylindrical test tubes.

Referring now to FIGS. 4–6, the present invention further comprises a thin, flat, disc-shaped tray 30 having a diameter slightly less than the inside diameter of bucket 15. Tray 30 has an internally threaded, axial hole 31 for receipt of the external threads 32 at one end of an elongate, generally rod-shaped lifting handle 33 which may have a knurled portion 34 at the other end thereof. Tray 30 may be made of any non-corrosive material and handle 33 may be made from any standard size bar stock.

With handle 33 attached to tray 30, the combination provides a means for lifting adaptors 20 from rotor bucket 15. More specifically, each adaptor 20 also has an axial hole 24 in the center thereof of a diameter which is slightly greater than the diameter of handle 33. Thus, handle 33 may be extended through hole 24, thereby positioning tray 30 in contact with the bottom of plate 21.

In operation, one or more adaptors 20 may be readily positioned on any suitable support for stacking of test tubes 17 therein. A first adaptor 20 may be positioned over handle 33, resting on tray 30. When it is desired to place adaptor 20 and the test tubes 17 therein into bucket 15, this may be achieved by grasping knurled portion 34 of handle 33 and lowering tray 30 and adaptor 20 into cavity 16 in bucket 15. Thereafter, and as shown in FIG. 5, a second adaptor 20 having a plurality of test tubes 17 therein may be positioned over the test tubes 17 in the first adaptor 20, with handle 33 extending through hole 24 in the second adaptor 20. In this position, the second adaptor 20 is supported above the caps 18 connected to the test tubes in the first adaptor 20.

Once connected to tray 30, handle 33 is not unscrewed for operation. Handle 33 extends through holes 24 in adaptors 20 and protrudes above the assembly for easy lifting after the centrifuge operation has been completed. Furthermore, it is not necessary to have two adaptors 20 in operation for support of handle 33 which is self-supported when installed into tray 30.

It can therefore be seen that in accordance with the present invention, the problems of the prior art are solved by the provision of a novel tube adaptor 20 and lifting apparatus 30,33 for use in a centrifuge rotor bucket 15. Adaptor 20 evenly distributes a number of test tubes 17 across the cross-section of bucket 15 and maximizes the number of test tubes 17 which are positionable in bucket 15. This is achieved by providing an adaptor in which each test tube 17 is supported for substantially less than the entire circumference thereof and for a distance which is substantially less than the length thereof. Since tubes 17 are not supported for their full lengths, adaptor 20 has a minimum weight and may be fabricated at a minimum cost. On the other hand, adaptor 20 is fully operative to support each test tube 17 individually and it is not necessary for a test tube 17 to be positioned in each of cavities 23 to support the remaining tubes 17.

The present invention also includes novel lifting apparatus including a lifting tray 30 and a lifting handle 33 useable with adaptor 20 to permit convenient loading of a first group of test tubes 17 into rotor bucket 15, stacking of a second group of test tubes 17 in rotor bucket 15, and subsequent removal of all test tubes therefrom.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. An apparatus having a centrifuge bucket for supporting test tubes, said apparatus comprising:

a thin, flat, disc-shaped plate having a diameter adapted to be fit within the inside diameter of the cavity of the centrifuge bucket and having an axial aperture located in the center of said plate;

a first series of partitions circumferentially spaced along the outer edge of said plate and made integral with and extending normal to one side of said plate;

a second series of partitions circumferentially spaced within said first series of said partitions on said plate and made integral with and extending normal to said one side of said plate;

a thin, flat, disc-shaped tray having a diameter slightly less than the diameter of said bucket, said plate having a bottom side opposite said one side of said plate, said tray located adjacent said bottom side of said plate; and an elongate, generally rod-shaped lifting handle, one end of said lifting handle being connected to the center of said tray, said one end of said handle extending through said hole in said plate to a position adjacent said bottom side of said plate to connect with said tray, the other end of said handle extending away from said one side of said plate in a direction opposite said bottom side of said plate, so that movement of said other end of said handle will move said plate in conjunction with said tray.

2. An apparatus according to claim 1 further comprising:

a second thin, flat, disc-shaped plate having a diameter adapted to be fit within the inside diameter of the cavity of the centrifuge bucket, said second plate having an axial hole therein for receipt of said handle, said second plate being stackable over said test tubes positioned in said cavities in said first plate;

a first series of partitions circumferentially spaced along the outer edge of said second plate and made integral with and extending normal to one side of said second plate; and a second series of partitions circumferentially spaced within said first series of partitions on said second plate and made integral with and extending normal to said one side of said second plate.

3. In combination:

a centrifugal bucket having a cylindrically shaped cavity and adapted to receive a plurality of cylindrical test tubes for centrifugation therein; and a thin, flat, disc-shaped plate having a diameter slightly less than the diameter of the cavity of said bucket, said plate being positioned in said cavity, parallel to the bottom of said bucket, for receiving the flat bottoms of said cylindrical test tubes positioned therein, said plate having a first series of partitions circumferentially spaced along the outer edge of said plate and a second series of partitions circumferentially spaced within said first series of partitions on said plate, partitions made integral with and extending normal to one side thereof, said partitions having a plurality of vertical surfaces defining a plurality of interrupted cavities for receipt of said test tubes, said partitions essentially filling the gaps between said tubes when they are positioned in said cavity of said bucket and are evenly distributed in a first circular pattern in contact with each other and the walls of said bucket and said vertical surfaces of said partitions and a second circular pattern in contact with each other and said test tubes in said first circular pattern, said partitions contacting and supporting substantially less than the entire circumference of each of said test tubes, and said partitions having lengths less than the diameter of said plate.

* * * * *